US009656149B2

(12) United States Patent
Hughes

(10) Patent No.: US 9,656,149 B2
(45) Date of Patent: May 23, 2017

(54) LEG PROTECTOR

(71) Applicant: Sports Design Concepts Limited, Ilford (GB)

(72) Inventor: Robert Hughes, Ilford (GB)

(73) Assignee: SPORTS DESIGN CONCEPTS LIMITED, Illford, Essex (GB)

( * ) Notice: Subject to any disclaimer, the term of this patent is extended or adjusted under 35 U.S.C. 154(b) by 0 days.

(21) Appl. No.: 14/380,327

(22) PCT Filed: Feb. 22, 2013

(86) PCT No.: PCT/GB2013/050449
§ 371 (c)(1),
(2) Date: Aug. 21, 2014

(87) PCT Pub. No.: WO2013/124679
PCT Pub. Date: Aug. 29, 2013

(65) Prior Publication Data

US 2015/0034511 A1 Feb. 5, 2015

(30) Foreign Application Priority Data

Feb. 22, 2012 (GB) ..... 1203077.1

(51) Int. Cl.
*A63B 71/12* (2006.01)
*B65D 85/18* (2006.01)

(52) U.S. Cl.
CPC ..... *A63B 71/1225* (2013.01); *B65D 85/18* (2013.01); *A63B 2071/1258* (2013.01); *A63B 2071/1275* (2013.01); *A63B 2209/10* (2013.01)

(58) Field of Classification Search
CPC ..... A63B 2071/1258; A63B 71/1225; A63B 2071/1275; B65D 85/18
USPC ..... 2/22, 239
See application file for complete search history.

(56) References Cited

U.S. PATENT DOCUMENTS 3,003,154 A * 10/1961 Litman ..... 2/239
3,465,364 A * 9/1969 Edelson ..... 2/22
4,099,269 A * 7/1978 Porner ..... A41D 13/0153 2/16
4,669,126 A * 6/1987 Jones ..... 2/22
(Continued)

FOREIGN PATENT DOCUMENTS

EP 1700625 A1 9/2006
EP 1852157 A2 11/2007
(Continued)

*Primary Examiner* — Richale Quinn
(74) *Attorney, Agent, or Firm* — Lawrence S. Cohen

(57) ABSTRACT

A leg protector for protecting the lower leg of a sports player against injury is disclosed. The leg protector comprises a sock and a plurality of protection pads. The sock is worn, in use, over the player's lower leg. Each protection pad comprises a rear surface that is detachably engageable with the worn sock so that, when engaged, the rear surface faces inward towards the player's lower leg and a corresponding front surface faces out away from the player's lower leg. Each of the plurality of protection pads are arranged for placement at a position that protects a respective area of the player's lower leg. A first protection pad can protect an upper shin area; a second protection pad can protect a lower shin and ankle area; and a third protection pad can protect a metatarsal area of the player's lower leg.

13 Claims, 4 Drawing Sheets

(56) References Cited

U.S. PATENT DOCUMENTS

| | | | | | |
|---|---|---|---|---|---|
| 4,674,157 | A * | 6/1987 | Litz | 24/442 | |
| 5,007,111 | A * | 4/1991 | Adams | 2/22 | |
| 5,507,720 | A * | 4/1996 | Lampropoulos | 602/27 | |
| 5,717,996 | A * | 2/1998 | Feldmann | A61F 5/0111 | 2/22 |
| 5,742,938 | A * | 4/1998 | Winningham et al. | A63B 71/1225 | 2/22 |
| 5,794,261 | A * | 8/1998 | Hefling | 2/16 | |
| 6,065,152 | A * | 5/2000 | Parker | 2/22 | |
| 6,079,128 | A * | 6/2000 | Hoshizaki et al. | 36/89 | |
| 6,301,722 | B1 * | 10/2001 | Nickerson et al. | 2/455 | |
| 6,490,730 | B1 * | 12/2002 | Lyden | 2/22 | |
| 8,209,883 | B2 * | 7/2012 | Lyden | 36/9 R | |
| 2002/0188997 | A1 * | 12/2002 | Lyden | 2/22 | |
| 2008/0120756 | A1 * | 5/2008 | Shepherd | 2/22 | |
| 2009/0100563 | A1 * | 4/2009 | Behrend et al. | 2/22 | |
| 2009/0205097 | A1 * | 8/2009 | Manning, II et al. | 2/22 | |
| 2012/0102613 | A1 * | 5/2012 | Loth et al. | 2/22 | |
| 2013/0198922 | A1 * | 8/2013 | Wittman | 2/22 | |
| 2014/0259260 | A1 * | 9/2014 | Behrend et al. | 2/22 | |

FOREIGN PATENT DOCUMENTS

| | | | |
|---|---|---|---|
| FR | 2927772 | | 2/2008 |
| GB | 2460019 | A | 11/2009 |
| WO | WO-0187432 | A2 | 11/2001 |
| WO | WO-2007064995 | A2 | 6/2007 |

* cited by examiner

Cross Section A-A

Cross Section B-B

LEG PROTECTOR

FIELD OF THE INVENTION

The present invention relates to a leg protector for use in protecting the lower leg and foot of a player during sports such as football (i.e. "soccer"), hockey, rugby and the like. In particular, the present invention relates to an apparatus for and method of protecting a sports player's upper shin, lower shin, ankle and metatarsal areas against injury.

BACKGROUND TO THE INVENTION

Injuries to the lower leg and foot area are common in sports such as football, hockey and rugby. For example, during a game of football, injury commonly results from collision between player's feet and legs during a tackle. It is known in the art to provide shin pads, and apparatus and methods are known for facilitating the fitting and use of such shin pads:

International Publication Number WO 2007/064995 (LUEKING) describes a sock with compression sections provided for holding shin pads in position along a player's shin.

French Patent Publication Number FR 2927772 (SOK FABRICE) describes a sports sock provided with 'scratch' parts (hook and loop/Velcro® fasteners) on the inside of the sock. A shin pad is provided with complementary scratch parts on its exterior surface allowing the sock and shin pad to be detachably attached to one another.

Disadvantageously, these arrangements merely describe ways in which existing shin pads can be held at the correct place on the upper shin. Additional they do not consider how to provide protection anywhere else apart from the upper shin. In particular, the ankle, lower shin and metatarsal areas of the lower leg are unprotected by shin pads and so still prone to injury. It will be appreciated that this is not an insignificant issue as one of the most common injuries in football is a fracture of the metatarsals.

Protective gear that can protect areas such as the ankle, the lower shin and metatarsal areas are also known, for example:

United States Patent Publication Number US 2009/205097 (MANNING) describes a soccer sock having a pad stitched therein, designed to absorb impact forces suffered by the upper metatarsal and ankle area of the foot.

United Kingdom Patent Publication Number GB 2460019 (NIESIOLOWSKI) describes a metatarsal/dorsum protector comprising a moulded pad shaped to fit over the top of the foot. A pad is provided specifically for each left and right foot, and is sandwiched in place between two socks. The pad only covers the metatarsal/dorsum area of the foot, and does not provide any ankle protection.

However, no single device addresses several shortcomings that have persisted in the art:

Firstly, no solution is proposed that provides integrated protection for all of the vulnerable areas of the lower leg—specifically, the metatarsal area, the ankle, the lower shin and the upper shin.

Secondly, sports players tend not to wear protective gear to protect vulnerable regions of the lower leg that need to flex or bend during player movement. Affordable, generic "off-the-shelf" devices are not tailored specifically to the size, shape and range of movement of an individual player, and so typically hinder movement or may be uncomfortable to wear. On the other hand, devices that are tailored specifically to each player do not lend themselves easily to low-cost mass-production.

Thirdly, protective devices for such regions of the lower leg can take a long time to fit properly, dissuading players against their use.

Fourthly, such protective devices cannot be immediately reused as shin pads can be—in particular, pads that are integral with sports socks and the like need to be washed before reuse.

It is against the present background that the present invention has been devised.

DISCLOSURE OF THE INVENTION

According to a first aspect of the present invention there is provided a leg protector for protecting the lower leg of a sports player against injury, the leg protector comprising:

a sock worn, in use, over the player's lower leg; and a plurality of protection pads, each arranged for placement at a position on the sock that protects a respective area of the player's lower leg.

Ideally, each of the plurality of protection pads comprise a rear surface that is detachably engageable with the worn sock so that, when engaged, the rear surface faces inward towards the player's lower leg and a corresponding front surface faces out away from the player's lower leg.

The plurality of protection pads may comprise a first protection pad being shaped and adapted to protect an upper shin area of the player's lower leg. The plurality of protection pads may comprise a second protection pad being shaped and adapted to protect a lower shin and ankle area of the player's lower leg. The plurality of protection pads may comprise a third protection pad being shaped and adapted to protect a metatarsal area of the player's lower leg. The sock may be a sports sock that covers the player's lower leg from the toes to just below the knee.

Advantageously, as the protection pads can be removed from the sock, the sock may be washed independently of the protection pad. In particular, this arrangement allows a player to own a number of socks and only a single set of protection pads. After each game, a player can remove the protection pads from each sock and refit them to a fresh pair.

A further advantage is associated with having independent protection pads; the construction and shape of each can be independently adapted for protecting each area of the lower leg. Furthermore, the position of each protection pad can be adjustable relative to another and so the relative arrangement of the protection pads can be configured specifically for each player so as to provide the best possible protection and comfort. In other words, the independence of the protection pads ensures that there is sufficient flexibility for adjustment for different players having different sized or shaped lower legs. This does away with the need to have protection pads that are bespoke to each player and, accordingly, the protection pads can be mass-produced, reducing their cost.

Additionally, the independence of each protection pad enhances the range of a player's leg and foot movement. For example, the flex and movement of the ankle region is not restricted by a device clamped around the player's shin. Nonetheless, as the protection pads are complementary in shape, gaps in the protection provided can be minimised.

To this end, the first and second protection pads may have complementarily-shaped mating portions enabling the first and second pads to be fitted together on the sock so as to substantially cover and protect the shin area of the player's lower leg. Ideally, the shape of each mating portion is such that gaps between the first and second protection pads are minimised during movement of the lower leg.

Preferably, the second protection pad comprises a band portion arranged to fit, at least in part, around the ankle of the player's lower leg. Preferably, the second protection pad comprises at least one flap integrally formed with and extending from the band portion so that when the band portion is fitted around the ankle, the at least one flap extends downwardly from the band portion to cover and protect a respective one of the ankle malleoli of the player's lower leg. Advantageously, the flaps can easily flex relative to the band portion during the movement of the players foot. Accordingly, this provides a convenient way of protecting the malleoli without sacrificing player movement.

Ideally, at least one of the flaps defines a concavity on the rear surface. Ideally, the concavity is arranged to cup and conform to a respective one of the ankle malleoli of the player's lower leg.

Ideally, at least one of the first and second protection pads is arranged to surround, at least in part, the player's lower leg. This can provide a more reliable fit as the pads can grasp onto the player's leg, rather than simply being mounted thereon. Moreover, in the case where the protection pads are attached to the sock using a fastening means (such as a hook and loop fastener), wrapping the protection pads around the lower leg far decreases the chance of the pads being dislocated, especially because of the fastening means high resistance to shear forces.

Ideally, at least one of the protection pads is predominantly constructed of an integral piece material. Ideally all of the protection pads are predominantly constructed from the same material. The material may be a sheet material. These features enable lower production costs to be realised. The material may be flexible and/or resilient. In contrast with solid shell devices, this reduces the extent to which a player's movement is hindered.

Ideally, the at least one protection pad can flex between a first configuration in which the at least one protection pad can be flat-packed and a second fitted configuration in which the at least one protection pad can attach to the sock and conform to the shape of the respective area of the player's lower leg. Advantageously, the flexing of the protection pads enables a better fit to a player's leg to be realised. Moreover, the ability of the protection pads to flex between a shape that conforms to the shape of a player's leg, and a flat shape can reduce the cost of the protection pads. In particular, flat-packing the protection pads can reduce the volume of the packaging, minimising costs associated with the production and transportation of the protection pads. Accordingly, an aspect of the present invention may additional reside in a flat-pack packaging containing the protection pads.

Ideally, at least one of the protection pads comprises one or more flex regions about which the at least one protection pads can flex. Ideally, the sheet material has at least one region of reduced thickness defining a flex region. Ideally, at least one of the protection pads comprises one or more fold regions about which the at least one protection pad can flex or fold. The fold regions may be defined by substantially linear lines of reduced thickness. The fold regions of each protection pad may be substantially aligned with one another. The fold regions may be spaced from one another. The fold regions may be defined by grooves in a front and/or rear surface of the production pads. Ideally, the sheet material has a plurality of regions of reduced thickness that define corresponding fold and/or flex regions. The fold regions may be a few millimeters wide. Advantageously, this allows the protection pads to be flexible without compromising on protection. By way of example, a thin material may be able to flex easily, but not afford much impact protection, whereas a thick material cannot flex easily—hindering a player's movement—but does provide a good level of protection. Having relatively thin, elongate fold regions obviates needing to make such a trade-off as the resulting protection pad can be both highly protective and flexible.

Ideally, the leg protector further comprises a fastening means for detachably engaging at least one of the protection pads to the sock. This can enable the protection pads to be adjustably positioned relative to one another and/or the sock.

The fastening means may be permanently affixed to at least one protection pad. Advantageously, this reduces the chance of the fastening means being separated from the protection pads and potentially misplaced, or not positioned correctly on the protection pad. Also, this can make it easier for a sports player to reuse the protection pad with different socks.

Ideally, the fastening means is permanently affixed to the rear surface of the at least one protection pads. Ideally, the fastening means is permanently affixed to the rear surface of the at least one protection pads over an area avoiding a peripheral region of that rear surface. Advantageously, this can make it easier for a sports player to remove the protection pad from the sock after use. For example, the peripheral region allows a player to more easily peel the protection pad away from the sports sock, allowing the player to grasp both the front and rear surface of the protection pad.

Ideally, the fastening means is permanently affixed to the at least one protection pads over an area predominantly avoiding the fold regions. Advantageously, this maintains the flexibility in the fold region. Furthermore, this reduces the chance that the fastening means is weakened or worn down as a result of folding stresses.

Ideally, the fastening means is at least partly countersunk into the at least one protection pads. Ideally, the rear surface of the at least one protection pads defines one or more depressions within which the fastening means is at least partly countersunk. Advantageously, this reduces the profile of the protection pads, and allows for a more reliable and comfortable fit.

Ideally, the fastening means comprises a first portion that is provided on the exterior of the sock and a second portion that is provided on the rear surface of at least one of the protection pads. Advantageously, this can increase the reliability and the speed at which the protection pads can be fitted to the sock. In particular, in the case where the fastening means is a hook and loop fastener, the pads are simply pressed directly onto the sock.

Ideally, an outer layer is provided onto the front surface of at least one the protection pads onto which graphics and branding can be printed. The outer layer may be laminated into the front surface.

The leg protector may comprise an outer sock, worn over the one or more protection pads and the inner sock to which those protection pads are retained. Advantageously, the outer sock can cover the protection pads, shielding them against dirt, thereby maintaining their integrity and promoting their reuse.

A second aspect of the present invention may reside in one or more protection pads for use with a leg protector according to the first aspect of the present invention.

A third aspect of the present invention may reside in a flat-packed package containing a leg protector, one or more protection pads and/or a sock according to the first or second aspects of the present invention.

According to a fourth aspect of the present invention, there may be provided a sock, such as a sports sock, comprising one or more protection pad retaining portions for removably retaining at least one protection pad at one or more predetermined positions about the sock.

Preferably, the sock comprises at least one protection pad. Preferably, the sock comprises a plurality of protection pads, each protection pad for protecting against injury at a different position of the lower leg or foot. Each protection pad may be arranged for placement at a respective predetermined position.

Preferably, the protection pad retaining portions comprise pockets for receiving protection pads therein. Advantageously, pockets allow pad insertion without the use of fastening means, which may otherwise deteriorate during wear and washing of the sock. Furthermore, the sock can be less complicated and can be manufactured at a lower cost than a sock requiring a fastening means to be provided. Additionally, a sock with pockets may be more comfortable to wear than one having fastening means provided thereon.

Alternatively, or in combination, the protection pad retaining portions of the sock may comprise fastening means for detachably attaching the protection pads thereon. Preferably, the fastening means is a flexible fastening means. Advantageously, the use of a flexible, fastening means confers comfort onto the wearer of the sock and does not inhibit movement. Preferably, the fastening means is washable. Preferably, the fastening means comprises hook-and-loop fasteners, such as Velcro®. Advantageously, the use of a fastening means, such a hook and loop fastener, allows the protection pad to be quickly attached to the sock.

Preferably, the fastening means comprises a first portion associated with the sports sock and a second portion, complementary with the first portion, associated with the protection pad. Preferably, the first portion of the fastening means provided on the sock, and the second portion of the fastening means is provided on the protection pad. Preferably, the first portion of the fastening means is provided on an exterior surface of the sock. Preferably, the second portion of the fastening means is provided on an inwardly facing surface of the protection pad. Preferably, in use, the protection pads are arranged to be located on the exterior of the sock. Advantageously, the sock is in closer contact with the lower leg and foot of a player than the protection pads, and so the combination of the sock and pads is more comfortable to wear.

Preferably, the second portion of the fastening means is distributed over the majority of the inwardly facing surface of the protection pad. Advantageously, in the case where the fastening means is of a type such as a hook and loop fastener, this allows the protection pad to be positioned at a range of positions relative to the sock, and also maximises the strength of the connection between the protection pad and the hook and loop fastener. The fastening means may be positioned in recesses or depressions in the inwardly-facing surface of the protection pads.

The one or more predetermined positions may comprise an upper shin position, a lower shin position, an ankle position and/or a metatarsal position about the sock.

Preferably, the predetermined positions comprise all of the upper shin, lower shin, ankle and metatarsal positions.

Conveniently, a player needs only to don the sock to provide protection to all of the vulnerable areas of the player's foot and lower leg. In particular, a player does not need separate protective gear for each of vulnerable areas. As well as from a convenience point of view, this also has the advantage that the protection pads can be shaped and arranged at the predetermined positions relatively to one another in a way that maximises both the protection afforded to the player without sacrificing the flexibility and freedom of movement of the player.

Preferably, the protection pads are made predominantly of a resilient material. The resilient material may be a foam material. The resilient material may be a closed cell, cross linked EVA copolymer foam or a closed cell, cross linked polyethylene, or may be a combination of the two. The base material may be laminated with a top layer material to allow for the printing of graphics/branding on to the product.

Preferably, a first protection pad is provided for protecting the upper shin, a second protection pad is provided for protecting the lower shin and ankle and a third protection pad is provided for protecting the metatarsal area. Advantageously, this arrangement presents an optimal way of protecting these areas without sacrificing a player's flexibility of movement.

Preferably, the first protection pad has a thickness of approximately 8 to 15 mm. Preferably, the second and third protection pads have a thickness of approximately 2 to 10 mm. The lower shin and ankle pad may have variable thickness. For example, thicker padding may be provided at the pads covering the parts of the lower shin that are more vulnerable to injury.

Preferably, the first portion of the fastening means comprises the material of the sock, and the second portion of the fastening means is provided on the protection pad. As such, the second portion on the protection pad is directly attachable to the material of the sock. Advantageously, this obviates the need for the first portion of the fastening means to be provided as an individual component on the sock.

Preferably, at least one of the upper shin, lower shin and ankle and metatarsal pads are arranged so that they can be flat-packed for packaging purposes. Preferably, one or more of the protection pads are provided with grooves for enabling the pads to readily flex around a player's leg and/or foot for more effective protection. Advantageously, the grooves are situated on the pads at positions allowing the pads to be flat-packed in a first configuration, and conform to the shape of a player's leg and/or foot in a second configuration.

The one or more protection pads are preferably provided in at least three predetermined sizes.

Preferably, the lower shin and ankle pads have regions of built-up thickness for additional impact absorption to protect the lower shin and the bony protrusions of the ankle. Advantageously, these regions are comprised of a resilient material which may be a closed cell, cross linked EVA copolymer foam or a closed cell, cross linked polyethylene, or may be a combination of the two.

Optionally, the one or more protection pads comprise a tightening means to tighten the pad relative to the player's leg and/or foot. The tightening means may comprise an elasticised portion for biasing the protection pads into the player's leg and/or foot. The tightening means may comprise a slot and complementary fastener portion. The complementary fastener portion may be sized and arranged to be threaded through the slot to enable tightening and loosening of the protection pads relative to the player's leg and/or foot. The tightening means may comprise a hook and loop fastener, such as a Velcro® strip fastener. Further, the upper shin, lower shin and ankle pads preferably each have at least one slot for threading Velcro® strip fasteners for pulling the pads in to the upper shin and lower shin and ankle.

The shin pad preferably has wings for wrapping around the back of the calf, providing additional protection, including protection by way of impact absorption.

The lower shin and ankle pad has circular ankle protectors that are concaved on the back to allow the pad to engulf the bony ankle protrusion and the surrounding area of the ankle, thus providing a more effective means of protection and a better fit.

According to a fifth aspect of the present invention there is provided a pair of socks according to any preceding aspect of the present invention. Preferably, the pair of socks include a left sock and a right sock for a respective left foot and right foot of a sports player. Preferably, the protection pads are shaped and arranged to be interchangeable with the left and right sock. Preferably, the protection pad retaining portions are shaped and arranged to permit the protection pads to be interchangeable with the left and right sock. Advantageously, this obviates the fitting of an incorrect set of pads to each sock.

According to a sixth aspect of the present invention there is provided one or more protection pads arranged for use with a protective sock according to the fourth or fifth aspect of the present invention.

According to a seventh aspect of the present invention there is provided a leg protector comprising one or more socks according to the fourth or fifth aspect of the present invention, and one or more protection pads according to the sixth aspect of the present invention.

According to an eighth aspect of the present invention there is provided a method of providing protection against injury to the foot and/or leg of a sports player. Ideally, the method comprises providing a leg protector according to any preceding aspect of the present invention. The method may comprises providing a sock comprising protection pad retaining portions and attaching one or more protection pads to the retaining portions of the sport sock. The method may comprise fitting the sock to the foot and/or leg of the sports player by including slots in the pad to accept Velcro straps.

It will be understood that features and advantages of different aspects of the present invention may be combined where context allows.

BRIEF DESCRIPTION OF THE DRAWINGS

Embodiments of the present invention will now be described with reference to the accompanying drawings in which.

SPECIFIC DESCRIPTION OF THE EMBODIMENTS

Figure 1:
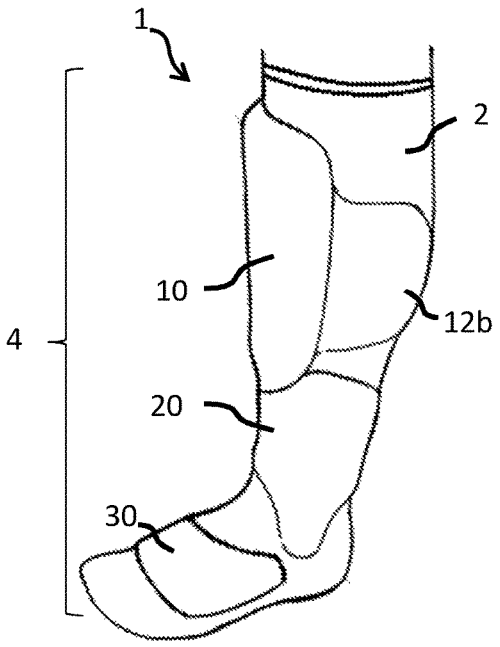
FIG. 1 is a schematic perspective side view of a leg protector according to a first embodiment of the present invention, the leg protector comprising an inner sock, a first protection pad, a second protection pad and a third protection pad, each fitted to a sports player's left lower leg below the knee.

FIG. 1 is a schematic perspective side view of a leg protector 1 according to a first embodiment of the present invention, fitted to a sports player's left lower leg 4 below the knee 3. It will be understood that, in practice, two leg protectors will be utilised by a sports player. However, in the interests of brevity, only one is shown and described herein.

Figure 2:
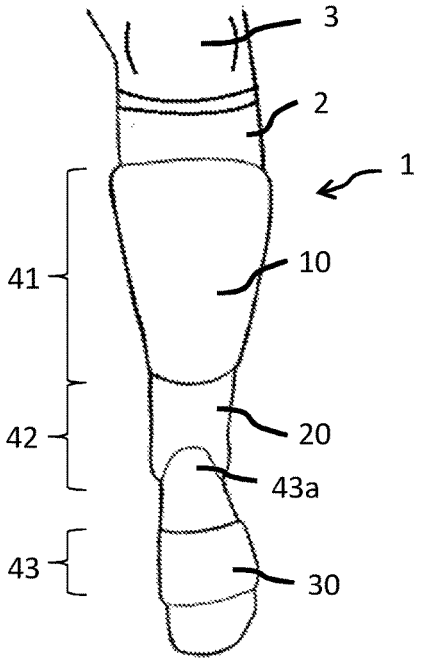
FIG. 2 is a schematic perspective front view of the leg protector of FIG. 1.

FIG. 2 is a schematic perspective front view of the leg protector 1 of FIG. 1. The leg protector 1 comprises a sock 2, a first protection pad 10 for protecting an upper shin area 41 of the lower leg 4, a second protection pad 20 for protecting a lower shin and ankle area 42 of the lower leg 4, and a third protection pad 30 for protecting a metatarsal area 43 of the lower leg 4. The first protection pad 10 may be referred to herein as an upper shin pad. The second protection pad 20 may be referred to herein as an ankle pad, or an "ankle and lower shin" pad. The third protection pad 30 may be referred to herein as a metatarsal pad.

Figure 3A:
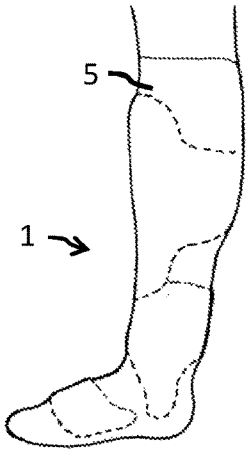
FIG. 3*a* is a schematic perspective side view of the leg protector of FIG. 1 comprising an outer sock fitted over the protection pads and the inner sock.
Figure 3B:
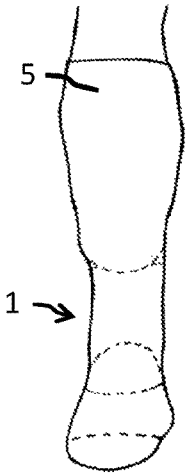
FIG. 3*b* is a schematic front view of the leg protector of FIG. 3*a*.
Figure 3C:
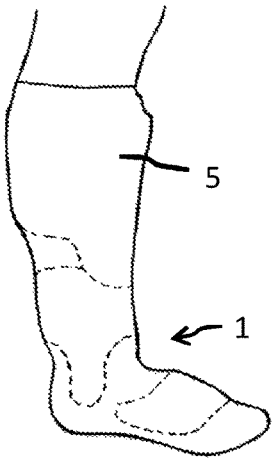
FIG. 3*c* is a schematic perspective reverse side view of the leg protector of FIG. 3*a*.

When fitting the leg protector 1, a sports player simply pulls the sock 2 over their lower leg 4, and then directly attaches the protection pads 10, 20, 30 to the exterior of the sock 2 at the appropriate location. Once the protection pads 10, 20, 30 have been fitted to the sock 2 the player may put on an additional outer sock 5 to cover the inner sock 2 and the protection pads 10, 20, 30. FIGS. 3*a*, 3*b* and 3*c* are various schematic perspective views of the leg protector of FIGS. 1 and 2 with the outer sock 5 fitted over the protection pads 10, 20, 30 and the inner sock 2. The outer "match" sock may serve as an aesthetic top layer, as well as providing additional support to hold the entire assembly of protection pads 10, 20, 30 in place.

Referring back to FIGS. 1 and 2, each protection pad 10, 20, 30 comprises a rear surface that engages with the sock 2 so that when the protection pads 10, 20, 30 are fitted to the sock, the rear surface faces towards the player's lower leg 4. Accordingly, the rear surface of the protection pads 10, 20, 30 is not visible in FIGS. 1 and 2—only a corresponding front surface is visible.

Figure 4:
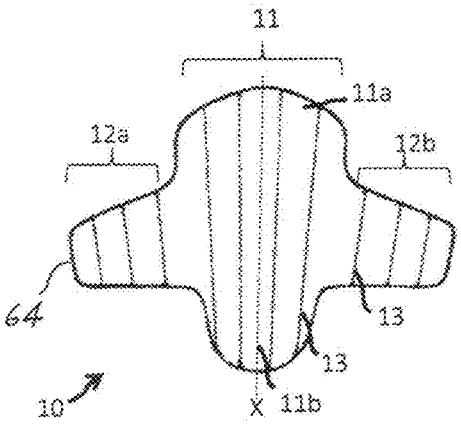
FIG. 4 is a front view of the first protection pad of the leg protector of FIG. 1.
Figure 7:
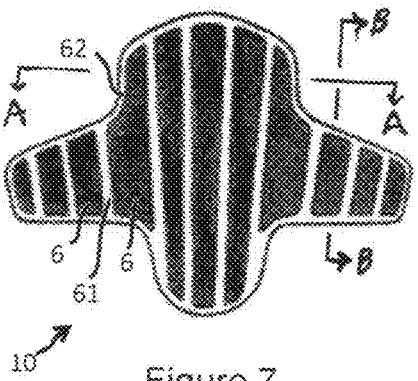
FIG. 7 is a rear view of the first protection pad of FIG. 4.
Figure 5:
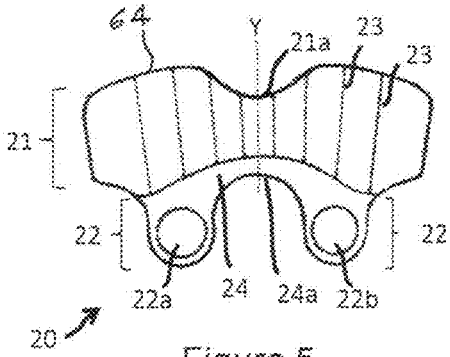
FIG. 5 is a front view of the second protection pad of the leg protector of FIG. 1.
Figure 8:
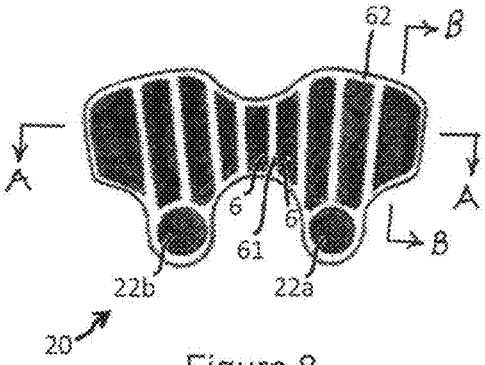
FIG. 8 is a rear view of the second protection pad of FIG. 5.
Figure 6:
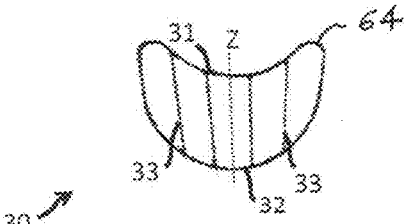
FIG. 6 is a front view of the third protection pad of the leg protector of FIG. 1.
Figure 9:
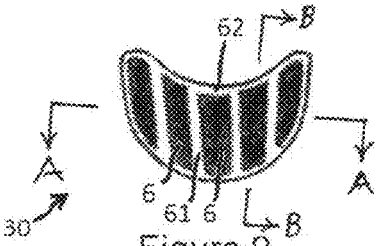
FIG. 9 is a rear view of the third protection pad of FIG. 6.

The front surfaces of the protection pads 10, 20, 30 are shown more clearly in FIGS. 4 to 6, and the rear surfaces of the protection pads 10, 20, 30 are shown in FIGS. 7 to 9. In FIGS. 4 to 9, the protection pads 10, 20, 30 are shown in isolation from the sock 2 and the lower leg 4 of the player. Moreover, whilst the protection pads 10, 20, 30 are shown in FIGS. 1 and 2 in a fitted configuration in which they conform to the shape of the player's lower leg 4, in FIGS. 4 to 9, the protection pads 10, 20, 30 are shown in a flat configuration, suitable for flat-packing. As will be described further, the protection pads can flex between these two configurations.

The protection pads 10, 20 and 30 are individually peripherally shaped as defined by each having an edge 64 as seen in FIGS. 4, 5 and 6 as well as in FIGS. 7, 8 and 9. The edge 64 extends around the entire periphery of each of protection pads 10, 20 and 30.

FIG. 4 is a front view of the first protection pad 10 of the leg protector 1 of FIG. 1. The first protection pad 10 is shaped to protect an upper shin area of the player's lower leg 4. Accordingly, the first protection pad 10 comprises an elongate body portion 11 extending from an upper end 11*a* to a lower end 11*b*, tapering toward the lower end 11*b* in conjunction with the natural taper of the lower leg 4 between the knee 3 and ankle region 42. Integrally-formed with the body portion 11 are a pair of wings 12*a*, 12*b* that extend laterally from the body portion 11, and are arranged to wrap around the calf of the lower leg 4 either side of the upper shin region 41, as shown in FIG. 1. Referring back to FIG. 4, the first protection pad 10 is substantially symmetrical about longitudinal axis X that bisects the body portion. Accordingly, the first protection pad 10 can be fitted on either leg. The longitudinal axis X extends between the upper end 11*a* and the lower end 11*b* of the body portion 11. Grooves 13 are defined in the front surface of the first protection pad 10 that extend longitudinally from opposing edges of the front surface of the first protection pad 10. The grooves 13 extend in a straight line and are spaced from one another. The grooves 13 are roughly aligned with one another, gently fanning out from the lower end 11*b* to the upper end 11*a* of the first protection pad 10.

The first protection pad 10 is predominantly constructed of an integral piece of resilient sheet material within which the grooves 13 create regions of reduced thickness. Accordingly, the grooves 13 define fold regions about which the first protection pad 10 can flex between the flat configuration shown in FIG. 4 and the fitted configuration shown in FIGS. 1 and 2.

FIG. 5 is a front view of the second protection pad 20. This is similar in construction to the first protection pad 10, in that it is made of an integral piece of resilient sheet material having a front surface within which spaced and fanning grooves 23 define fold regions. Furthermore, the second protection pad 20 is also symmetrical—about a longitudinal axis Y. However, this second protection pad 20 is shaped and adapted to protect the lower shin and ankle area 42 of the player.

The second protection pad 20 comprises a band portion 21 that is arranged to fit around the ankle and lower shin 42 of the lower leg 4. The second protection pad 20 further comprises a pair of flaps 22 that are integrally-formed with the band portion 21, and extend therefrom either side of, and aligned with the longitudinal axis Y. Thus, when the second protection pad 20 is fitted around the lower shin and ankle region 42, the flaps 22 hang down from the band portion 21 to cover the ankle malleoli (i.e. the laterally-extending bony protrusions of the foot in the region of the ankle). Moreover, each flap 22 defines a circular formation 22*a*, 22*b* which cups and conforms to a respective one of the ankle malleoli.

The circular formations 22*a*, 22*b* surmount and are supported by a bridge region 24 which extends between the circular formations 22*a*, 22*b* and the band portion 21. At the front surface of the second protection pad 20, the circular formations 22*a*, 22*b* are convex, extending proud of the underlying bridge region 24. The circular formations 22*a*, 22*b* are concave on the rear surface of the second protection pad 20, shown in FIG. 8.

Referring back to FIG. 5, the bridge region 24 defines an area of reduced thickness in the sheet material from which the second protection pad 20 is constructed; the area of reduced thickness being thinner than the band portion 21. Accordingly, whilst grooves 23 are set into, and extend across the band portion 21 to promote flexibility, this is not necessary for the thinner and more flexible bridge region 24.

The bridge region 24 defines a recess 24*a* between the flaps 22 so that the wide range of movement exhibited in the tarsal region 43*a* of the foot is not inhibited. The recess 24*a* is arcuate in shape to promote comfort and range of movement without sacrificing movement.

The band portion 21 is also shaped to define an arcuate recess 21*a* at its upper end, leading to the protection pad 20 having a shape which is constricted along its longitudinal axis Y.

Viewed another way, the second protection pad 20 is shaped broadly like a butterfly, the band portion 21 being shaped like the butterfly's forewings, and the flaps 22 being shaped like the butterfly's smaller hindwings.

The shape of the second protection pad 10 at its upper end is complementary with the shape of the lower end of the first protection pad 10. Specifically, the rounded end 11*b* of the first protection pad 10 fits into the arcuate recess 21*a* of the second protection pad 20. Accordingly, the first and second protection pads 10, 20 have complementarily-shaped mating portions enabling the first and second pads 10, 20 to be fitted together on the sock 2 so as to substantially cover and protect the entire shin area of the player's lower leg, as shown in FIGS. 1 and 2.

FIG. 6 is a front view of the third protection pad 30. Again, this is similar in construction to the first and second protection pads 10, 20, in that it is made of an integral piece of resilient sheet material having a front surface within which spaced and fanning grooves 33 define fold regions. Furthermore, the third protection pad 20 is also symmetrical—about a longitudinal axis Z. The third protection pad 30 is broadly crescent-shaped, and is fitted over the metatarsal area of the foot. Thus, in use, the third protection pad will typically sit behind the laces of a football boot, and be sandwiched between the boot and the player's foot.

The rear surfaces of the protection pads 10, 20, 30 will now be described with reference to FIGS. 7 to 9 in which FIG. 7 is a rear view of the first protection pad 10 of FIG. 4; FIG. 8 is a rear view of the second protection pad 20 of FIG. 5; and FIG. 9 is a rear view of the third protection pad 30 of FIG. 6.

Figure 10:
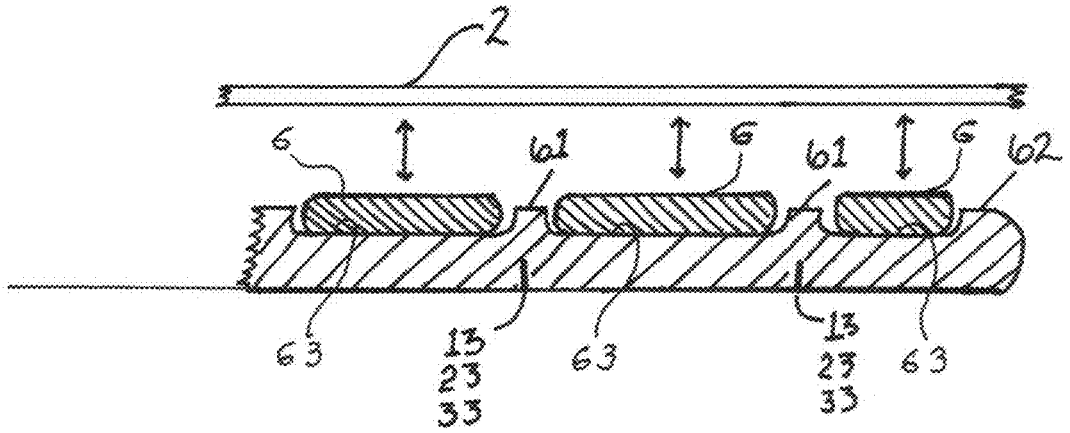
FIG. 10 is a sectional view of the cross-section A-A shown in FIGS. 7, 8 and 9.
Figure 11:
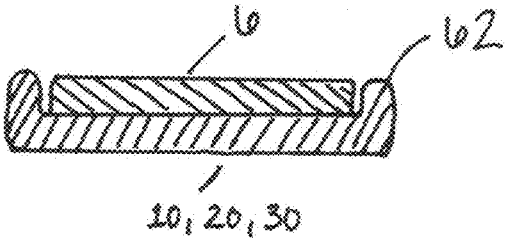
FIG. 11 is a sectional view of the cross-section B-B shown in FIGS. 7, 8 and 9.

Referring collectively to FIGS. 7 to 9, and with further reference to FIGS. 10 and 11 each of the protection pads 10, 20, 30 comprise fastening means 6 that are affixed to the rear surfaces of each protection pad 10, 20, 30. Specifically, the fastening means of the protection pads 10, 20, 30 is a material comprising the hook part of a hook and loop fastening material (such as Velcro®). This is permanently glued onto the rear surface of each of the protection pads 10, 20, 30 such that the hooks face away from the rear surface. Thus, as the protection pads 10, 20, 30 are pressed on to the sock 2, the hooks are able to engage with the material of the sock 2 so that the protection pads 10, 20, 30 can be detachably attached to the sock 2. To this end, the sock 2 incorporates a material comprising the loop part of a hook and loop fastening material. Advantageously, many materials from which existing socks are already made contain a sufficient number of loop parts, and so the protection pads 10, 20, 30 can be retrofitted onto existing socks. However, to maximises the security with which the protection pads 10, 20, 30 are fitted, it is preferred that the sock 2 of the present embodiment is used. In particular, the sock is manufactured and provided specifically for use with the protection pads 10, 20, 30; having a high density of loop parts. Furthermore, the sock 2 may provide markings thereon that guide a user to fit the protection pads 10, 20, 30 onto the correct part of the sock 2 (not shown).

The fastening means 6 does not cover the entire rear surface of the protection pads 10, 20, 30. Rather, gaps 61 in the coverage are provided at the locations where the protection pads 10, 20, 30 are intended to flex. Accordingly, these gaps corresponding to the locations at which grooves 13, 23, 33 are provided on the front surface of the protection pads 10, 20, 30. The gaps 61 therefore define the fastening means 6 as a plurality of separate members as seen in FIGS. 7, 8 and 9 and as further illustrated in the section views of FIGS. 10 and 11.

Furthermore, the fastening means 6 does not extend up to the edge 64 of the rear surface of the protection pads 10, 20, 30. Accordingly, a border 62 is defined around the periphery of the rear surface of the protection pads 10, 20, 30 that is free of a fastening means 6. This makes it easier to remove the protection pads 10, 20, 30 from the sock 2, as it makes it possible for a player to grip the front and rear surface to peel away the protection pads 10, 20, 30 from the sock 2.

The fastening means 6 are not affixed to a wholly smooth rear surface of the protection pads 10, 20, 30. Rather, depressions 63 are provided in rear surface of the protection pads 10, 20, 30 into which the fastening means are partly countersunk. This reduces the profile of the protection pads and ensures that the protection pads 10, 20, 30 closely conform to the shape of a sports player's lower leg 4 when worn on the sports sock 2.

The foregoing can be seen in the sectional views of FIG. 10 and FIG. 11 with further reference to the sections A-A and B-B in FIGS. 7, 8 and 9. Section A-A is shown in FIG. 10 in which the fastening means 6 is separated by gaps 61 and installed in depressions 63. Also the grooves 13, 23 and 33 (as shown in FIGS. 4, 5 and 6 respectively) are illustrated as corresponding to the gaps 61 in each of protection pads 10, 20, 30. Referring back to FIGS. 1 and 2, the protection pads 10, 20, 30 can therefore be quickly and conveniently applied to the sock 2 to provide integrated protection for all of the vulnerable areas of the lower leg—specifically, the metatarsal area 43, the ankle and lower shin 42 and the upper shin 41. A player merely has to press the appropriate protection pad 10, 20, 30 to the correct region of the lower leg 4 to engage the fastening means 6 to the sock 2. The hook component of the fastening means 6 is provided on the inwardly facing surface of the protection pads 10, 20, 30, and the loop component is provided on the exterior surface of the socks. When the appropriate protection pad 10, 20, 30 is married up to its respective position on the sock 20, the complementary components of the fastening means attach to one another and hold the protection pads 10, 20, 30 on the socks.

In the case of the first protection pad 10, the player ensures that it can be securely fitted onto the sock by wrapping the wings 12*a*, 12*b* around the calf of the leg. In the case of the second protection pad 20, the player simply wraps the band portion securely around the ankle. The first and second protection pads 10, 20 have mating interfaces that allow a complete range of movement of the lower leg 4, yet provide uninterrupted coverage and protection of the player's shin area.

Thus a first embodiment of the present invention has been described. It will be appreciated that the foregoing embodiment relates only to a preferred embodiment of the invention. A person skilled in the art would recognise that this embodiment is not intended to limit the scope of protection, and equivalents and variants are possible. Some of the extensions, variants and alternatives to the first embodiment of the present invention will now be listed, the features and advantages of which may be combined with the first embodiment where context allows.

The sock may be a sports sock similar in construction to a conventional football, rugby and/or hockey sock. The sock may be arranged to allow each of the pads to be removably retained on the sock. The pads may be kept at positions about the sock to provide protection to respective parts of the lower leg and foot of a football, rugby and/or hockey player. The pads may be so positioned and arranged to protect against the fracturing of certain vulnerable bones in the legs and feet. In particular, the metatarsal pad may provide protection to the metatarsal area of the foot, the lower shin and ankle pad may provide protection to the ankle, fibula and lower shin area of the leg and the upper shin pad may provide protection to the upper shin area and calf.

In alternatives, the metatarsal pad, when laid flat, may be approximately oblong in shape with rounded corners, and retained about the sock so that it covers an area above the metatarsals. When a conventional football boot is worn on top of the leg protector, this metatarsal pad resides behind the laces of the boot.

The lower shin and ankle pad may be approximately band-shaped, and fitted in position about the sock, at the ankle and lower shin area of the leg.

The shin pad may be shaped and function in a way similar to a conventional shin pad—i.e. it covering the front-facing region of the leg around the shin. Each pad may be made of a closed cell, cross linked EVA copolymer foam or a closed cell, cross linked polyethylene, or may be a combination of the two. Each pad may be formed to complement the shape of the leg or foot area that each pad protects. The sock may typically comprise 94% Nylon and 6% Elastane.

Each sports sock onto which the pads are retained may be similar to a conventional football, rugby and hockey sock—i.e. constructed from a washable fabric, for example a synthetic textile material, and is elasticated at its upper end.

The fastening means may be stitched to the protection pads.

The ankle pad may have an area of thickness built up to provide additional support and protection to the lower shin and the bony protrusions of the ankle. The protection is provided by shock absorbing characteristics of the built up region. These characteristics may be provided by shock absorbent closed cell, cross linked EVA copolymer foam or a closed cell, cross linked polyethylene based foam, or a combination of the two types of foam.

As mentioned, the assembly of the metatarsal, lower shin and ankle and upper shin pads can be flat-packed for efficiency of packaging and transportation purposes. Accordingly, a package may be provided containing the flat-packed protection pads.

Instead of, or in addition to the fastening means, protection pad retaining portions may be provided on the sock. In particular, the sock may comprise pockets sewn into its exterior surface which are shaped for receiving a respective one of the protection pads. The pockets are may be arranged about the sock to retain the pads to the sock and hold them in the correct position. In use, a player can simply tuck the pads into the pockets of each sock before putting on football, hockey or rugby boots. After a football, hockey or rugby game, the pads can pulled out from the pockets and refitted into a fresh pair of sports socks. The soiled pair of socks can thus be washed independently of the pads. Advantageously, this means that the pads are immediately available for use, rather than needing to be washed and dried—as is the case with the socks. Furthermore, not washing the pads can improve their longevity. In particular, the sport socks may be washed at temperatures and/or other washing conditions that may spoil the condition of the pads—but are necessary to clean the sports socks.

In further embodiments, at least one of the protection pads may comprise a band or strap that wraps around the lower leg and pulls the protection pad into the lower leg of the player. The band may be resilient. The band may be adjustable. For example, the lower shin and ankle pads may have slots for threading a separate Velcro® strip fastener to pull the pads in tightly around the back of the upper and lower shin. These slots can be provided at the sides of the pads and enable a more secure attachment of the protection pads and undersock to the user's lower leg.

Ideally, the protection pads are provided in a discrete number of sizes—ideally three sizes "senior", "junior", and "childrens".

A family of products may be provided which can be used in combination or separately as individual units.

The invention claimed is:

1. A leg protector for protecting the lower leg of a sports player against injury, the leg protector comprising:

a sock worn, in use, over the player's lower leg; and a plurality of flexible protection pads, wherein a rear surface of each protection pad comprises a fastening means covering an area of the rear surface that detachably engages with the worn sock so that, when engaged, the rear surface faces inward towards the player's lower leg and attaches to the worn sock and a corresponding front surface faces out away from the player's lower leg and wherein the fastening means thereby enables at least one of the protection pads to be adjustably positioned relative to one another and the sock, the fastening means comprising a hook and loop fastener form in which the hook portion is on the rear surface of the at least one protection pad and comprises a plurality of separate members separated by gaps, and the loop portions are on the sock; and each of the plurality of protection pads defines depressions within which the plurality of separate members are at least partly recessed, and are arranged for placement at a position that protects a respective area of the player's lower leg, the plurality of protection pads comprising at least one of:

a first protection pad being shaped and adapted to protect an upper shin area of the player's lower leg;

a second protection pad being shaped and adapted to protect a lower shin and ankle area of the player's lower leg, wherein the second protection pad comprises;

a band portion arranged to fit, at least in part, around a lower shin and ankle area of the player's lower leg; and at least one flap integrally formed with and extending from the band portion so that when the band portion is fitted around the lower shin and ankle, the at least one flap is adapted to extend downwardly from the band portion to cover and protect a respective one of the ankle malleoli of the player's lower leg; and a third protection pad being shaped and adapted to protect a metatarsal area of the player's lower leg.

2. The leg protector of claim 1, wherein the first and second protection pads have complementarily-shaped mating portions enabling the first and second pads to be fitted together on the sock so as to substantially cover and protect the shin area of the player's lower leg.

3. The leg protector of claim 1, wherein at least one of the flaps defines a concavity on the rear surface that is shaped and arranged to cup and conform to a respective one of ankle malleoli of the player's lower leg.

4. The leg protector of claim 1, wherein at least one of the first and second protection pads is arranged to surround, at least in part, the player's lower leg.

5. The leg protector of claim 1, wherein at least one of the protection pads is predominantly constructed of an integral piece of resilient sheet material.

6. The leg protector of claim 1, wherein at least one of the protection pads comprises a plurality of slits on the front surface thereby defining one or more fold regions and about which the at least one of the protection pads can flex between a first configuration in which the at least one of the protection pads is flat and a second fitted configuration in which the at least one of the protection pads can attach to the sock and conform to the shape of the respective area of the player's lower leg.

7. The leg protector of claim 6, wherein at least one of the protection pads is predominantly constructed of an integral piece of resilient sheet material, and wherein the sheet material has a plurality of regions of reduced thickness that define corresponding fold regions.

8. The leg protector of claim 1, wherein the fastening means is permanently affixed to the rear surface of the at least one of the protection pads over an area avoiding a peripheral region of that rear surface.

9. The leg protector of claim 1 wherein at least one of the protection pads comprises one or more fold regions about which the at least one of the protection pads can flex between a first configuration in which the at least one of the protection pads is flat and a second fitted configuration in which the at least one of the protection pads can attach to the sock and conform to the shape of the respective area of the player's lower leg and wherein the fastening means is permanently affixed to the rear surface of the at least one protection pads over an area predominantly avoiding the fold regions.

10. The leg protector of claim 1, further comprising an outer layer laminated onto the front surface of at least one of the protection pads onto which graphics and branding can be printed.

11. The leg protector of claim 1 wherein the at least one protection pad has an edge and the hook portion on the rear surface of the at least one protection pad does not extend to the edge thereby defining a border around the periphery of the rear surface of the at least one protection pad that is free of a fastening means.

12. The leg protector of claim 11 wherein the at least one protection pad comprises the first protection pad, the second protection pad and the third protection pad.

13. The leg protector of claim 1 wherein the at least one protection pad comprises the first protection pad, the second protection pad and the third protection pad.

* * * * *